US005607163A

United States Patent [19]

Nesler

[11] Patent Number: 5,607,163

[45] Date of Patent: Mar. 4, 1997

[54] GRANULATE BACKSTOP ASSEMBLY

[75] Inventor: Leslie F. Nesler, St. Paul, Minn.

[73] Assignee: Caswell International Corporation, Minneapolis, Minn.

[21] Appl. No.: 450,821

[22] Filed: May 25, 1995

Related U.S. Application Data

[63] Continuation-in-part of Ser. No. 207,855, Mar. 8, 1994, Pat. No. 5,435,571, which is a continuation-in-part of Ser. No. 965,749, Oct. 23, 1992, Pat. No. 5,340,117, and a continuation of Ser. No. 643,539, Jan. 18, 1991, Pat. No. 5,171,020.

[51] Int. Cl.[6] ..... F41J 1/12

[52] U.S. Cl. ..... 273/410

[58] Field of Search ..... 273/410

[56] References Cited

U.S. PATENT DOCUMENTS

| | | | |
|---|---|---|---|
| D. 329,680 | 9/1992 | Burn | D22/113 |
| 941,642 | 11/1909 | Maxim | 273/410 |
| 4,294,452 | 10/1981 | Schlotter et al. | 273/403 |
| 4,728,109 | 3/1988 | Simonetti | 273/410 |
| 4,787,289 | 11/1988 | Duer | 273/410 X |
| 4,819,946 | 4/1989 | Kahler | 273/404 |
| 4,846,043 | 7/1989 | Langsam | 273/403 |
| 4,919,437 | 4/1990 | Salabe et al. | 273/410 |
| 5,070,763 | 12/1991 | Coburn | 273/410 |
| 5,113,700 | 5/1992 | Coburn | 273/410 |
| 5,121,671 | 6/1992 | Coburn | 273/410 |
| 5,171,020 | 12/1992 | Wojcinski | 273/410 |
| 5,340,117 | 8/1994 | Wojcinski | 273/410 |
| 5,435,571 | 7/1995 | Wojcinski et al. | 273/410 |

FOREIGN PATENT DOCUMENTS

| | | | |
|---|---|---|---|
| 3131228 | 3/1983 | Germany | 273/410 |
| 3212781 | 10/1983 | Germany | 273/410 |

*Primary Examiner*—William H. Grieb

*Attorney, Agent, or Firm*—Merchant, Gould, Smith, Edell, Welter & Schmidt, P.A.

[57] ABSTRACT

A range backstop assembly including a container having a plurality of sides. At least two of the sides have openings typically closed by a rubber sheet and serving for projectile entry. The container is filled with a particulate flowable granulate material which slows down the entering projectiles. The range backstop also includes a structure for facilitating movement of the backstop.

16 Claims, 10 Drawing Sheets

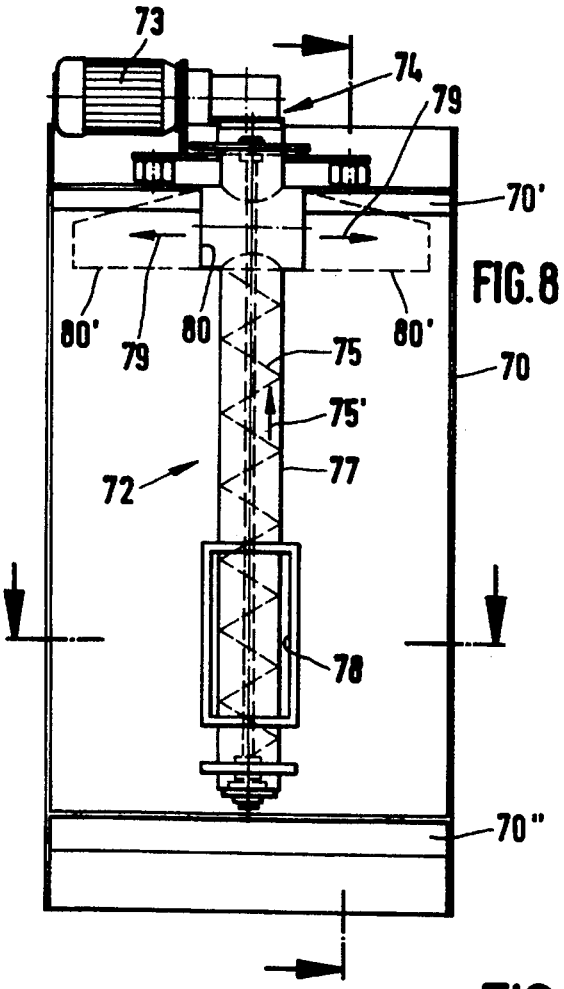
FIG. 8
FIG. 9A
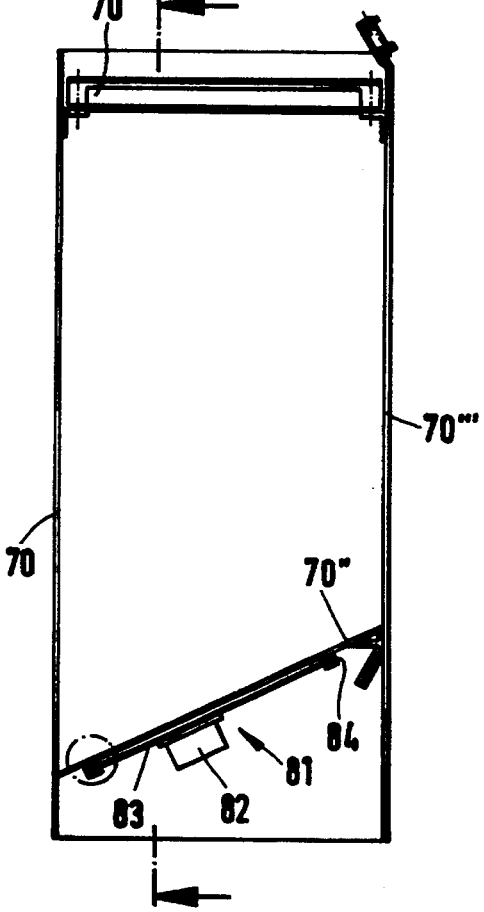
FIG. 9B
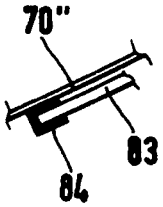
FIG. 10
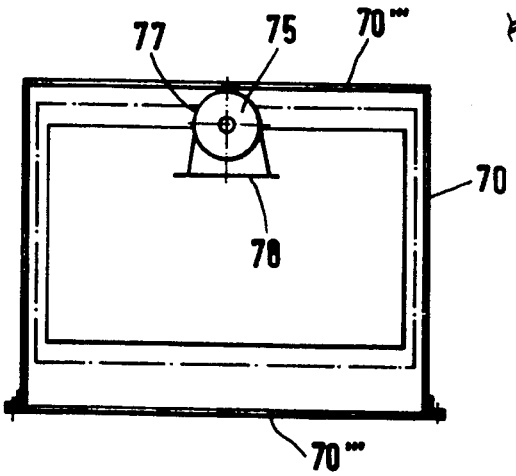

XIII
XII
90
90'
90''
90'''
91
92
93
94
95
96
97
98
99
100
101
102
103
104
105

GRANULATE BACKSTOP ASSEMBLY

CROSS REFERENCE TO PARENT APPLICATION

This application is a continuation-in-part of U.S. patent application Ser. No. 08/207,855, filed on Mar. 8, 1994, which was issued as U.S. Pat. No. 5,435,571 on Jul. 25, 1995, which is a-continuation-in-part of U.S. patent application Ser. No. 07/965,749, filed Oct. 23, 1992, which was issued as U.S. Pat. No. 5,340,117 on Aug. 23, 1994 and is a continuation of U.S. patent application Ser. No. 07/643,539, filed Jan. 18, 1991, which was issued as U.S. Pat. No. 5,171,020 on Dec. 15, 1992.

FIELD OF THE INVENTION

The present invention generally relates to range safety devices, and more specifically to a projectile backstop assembly using granulate material.

BACKGROUND OF THE INVENTION

A number of backstop assemblies have been known whose object is to slow down projectiles fired into them along a specified distance until they drop to the ground. For example, German Patent 31 31 228 discloses a backstop assembly in which multiple panels are vertically spaced from each other in two rows so that zigzag passages are formed between the panels of the rows where projectiles are bounced back and forth until they have slowed down enough to drop to the ground. DE-OS 32 12 781 discloses another backstop assembly wherein a container holds a granulate bonded by a bonding agent into a lumped structure, of which the objective also is to slow down projectiles fired into the granulate.

One drawback of the prior granulate-type backstop assembly is that it is difficult to dispose since the projectiles fired into the bonded granulate are retained thereby, i.e. they become part of the bonded granulate. As a consequence, removal of the projectiles is possible only by disposing the bonded granulate together with the projectiles embedded therein. Thus the quantities to be disposed of per unit backstop operating time are relatively high. Further, a major effort and considerable expense are needed to separate the bonded granulate from the projectiles embedded therein.

Therefore, there is a need for an improved backstop assembly of the kind specified above so that projectiles may be disposed in a simpler and more efficient manner.

SUMMARY OF THE INVENTION

The present invention provides a granulate backstop assembly that allows simple disposal of projectiles. In particular, the granulate may be separated in a simple and efficient manner from the slowed-down projectiles included therein. As a consequence, the projectiles or projectile fragments may be recovered very simply and reconditioned and further processed. At the same time the granulate so reconditioned may be re-used in the backstop assembly. The overall operating costs of the inventive backstop assembly are greatly reduced since the granulate used as a slowing-down medium may be re-used and the quantities ultimately to be disposed of, i.e. the projectiles removed from the backstop assembly, are much smaller. Further, the inventive backstop assembly does not involve the outages needed in prior assemblies to replace the slowing-down media (rubber louvers or bonded granulate) used therein.

One embodiment of the present invention is a backstop assembly including a container having a plurality of sides, at least two of the sides defining target openings for allowing projectiles such as bullets to enter the container. The target openings are enclosed by a plurality of self-healing sheets such that the projectiles penetrate the self-healing sheets in order to enter the container. A particulate material is contained within the container for slowing down and capturing the projectiles within the container. The backstop assembly also includes a structure for facilitating movement of the backstop assembly such that the backstop assembly can be easily reoriented to expose different sides to projectile fire.

Another embodiment of the present invention is a backstop assembly including a container having an opening covered by a self-healing medium for allowing projectiles to enter the container. The container includes first and second chambers which are filled with particulate material for slowing down and capturing the projectiles within the container. The first and second chambers are separated such that particulate material and spent projectiles can be removed from the first chamber without removing the particulate material and spent projectiles within the second chamber thereby improving the cost effectiveness of the backstop assembly.

A variety of advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows:

FIG. 8 shows a backstop assembly with an agitating mechanism for the granulate location in the container;

FIG. 9A shows a cross-sectional view of the embodiment of FIG. 8;

FIG. 9B shows an exploded view of a detail of FIG. 9A;

FIG. 10 shows another cross-sectional view of the embodiment of FIG. 8;

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

Figure 1:
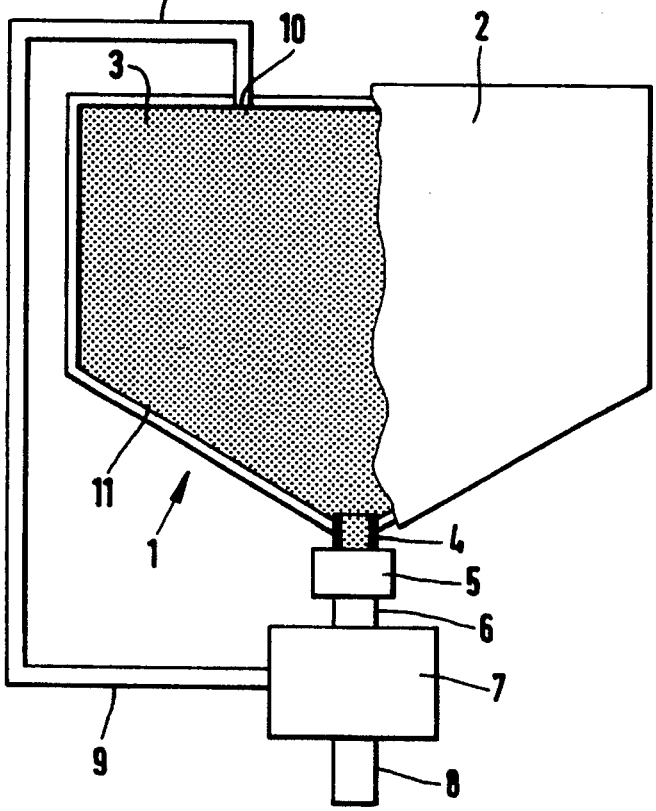
FIG. 1 shows a schematic view partly in section of the structure of the preferred embodiment of the inventive backstop assembly.

As shown in FIG. 1, the present granulate backstop assembly substantially comprises a preferably box-like container 1 having on one side, which is located behind a target surface, an opening 11 closed by a preferably disk-like medium 2 through which the projectiles fired towards the target area may pass. Medium 2 preferably comprises a rubber sheet. Because of the rubber material's inherent elasticity, the holes formed in rubber sheet 2 as the projectiles penetrate it close automatically when the projectiles have passed completely through sheet 2. Rubber sheet 2 is preferably mounted in front of opening 11 in such a manner that it closes opening 11 like a wall panel. It will be recognized that other well-known self-healing sheets, for example polymer sheets, may be substituted for the rubber sheet without loss of generality.

Container 1 has therein a granulate 3, which generally comprises a particulate flowable soft material capable of slowing down the projectiles fired into container 1 through rubber sheet 2, such slowing-down taking place along length L (FIG. 2) of container 1. Granulate 3 preferably consists of a particulate rubber material having an exemplary particle size of approx. 6 mm; a material of this kind is commercially available as a waste product.

In the operation of the present backstop assembly, the projectiles fired towards the target area disposed in front of rubber sheet 2 penetrate the latter. On the way along distance L of container 1, granulate 3 slows the projectiles down. For disposing of the contents of container 1 after some time, it is necessary merely to discharge granulate 3 and the projectiles and projectile fragments therein and to fill container 1 with fresh granulate 3. To this end, container 1 may have a discharge opening such as the pipe-shaped opening 4 shown in FIG. 4 and a fill opening (not shown) e.g. in the top container wall. The projectiles and projectile fragments contained in the discharged granulate may be removed from the latter in a simple known-per-se manner, as will be described in greater detail below.

Figure 2:
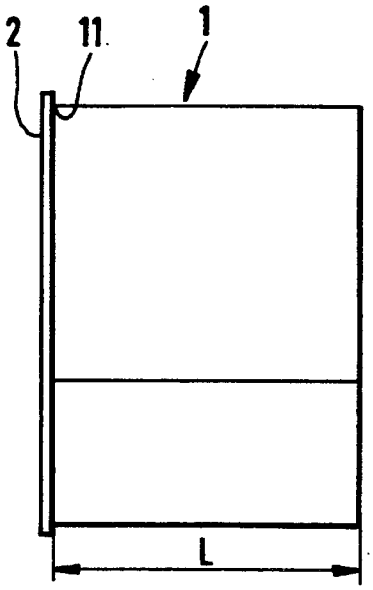
FIG. 2 shows a side view of the container of the preferred backstop assembly of FIG. 1.
Figure 3:
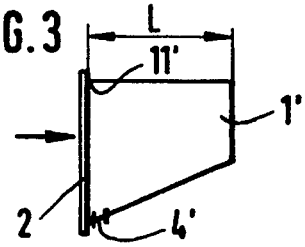
FIG. 3 shows one special form of the container in the inventive backstop assembly.
Figure 4:
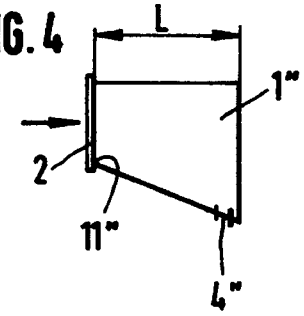
FIG. 4 shows another special form of the container in the inventive backstop assembly.

FIGS. 1–4 show preferred embodiments of the container. As shown in FIG. 3, the container is box-like in shape, with rubber sheet 2 forming the front wall of container 1' and closing opening 11' defined by the sidewalls, the top wall and the bottom wall. On its side opposite rubber sheet 2, the container is sealed by a rear wall. The bottom wall of the container starts at the bottom end of the rear wall and slopes downwardly towards rubber sheet 2 so that the lower-most point of the container lies about where the bottom wall meets rubber sheet 2. A granulate discharge opening 4' is located in that same area. The container of FIG. 4 is similar in construction to that of FIG. 3—apart from the fact that the bottom wall starts at rubber sheet 2 and slopes downwardly towards the rear wall so that the lowest point of container 1" lies about where their ear wall meets the bottom wall. Preferably, a discharge opening 4" is located in that area. Container 1 of FIGS. 1 and 2 is box-like in shape as well, with the bottom wall of container 1 having a tapered hopper shape, with the top opening of the hopper being attached to the container walls; the bottom end of the container forms discharge opening 4. Discharge opening 4, 4', 4" preferably is formed by a short length of pipe attached to container 1, 1', 1" and is sealable by means of a cover or the like.

It should be noted that rubber sheet 2 of container 1, 1', 1" may be disposed behind a target surface or may itself form that target surface. To this end, rubber sheet 2 may be externally coated with a white material to serve as a projection screen for stationary or moving target images generated by means of a suitable projector. In the simplest case, the fired-upon granulate is disposed of in any way desired at a location separate from the backstop after having been discharged from container 1, 1', 1".

In a preferred embodiment of the present backstop assembly, the aforesaid disposal is performed automatically as shown in FIG. 1. To this end, discharge opening 4 is connected through a valve 5 with input 6 of separating means 7 having a first output connected to line 9 and a second output 8. In separating means 7, the particulate granulate 3 is separated from projectile fragments, with the latter being passed on to output 8 and the granulate being recycled to container through return line 9 and an opening 10 in a container wall.

Advantageously, separating means 7 sucks off the granulate and the projectile fragments from container 1 through opened valve 5, with separating means 7 further utilizing the difference in weight of granulate 3 and the projectile fragments to so separate them that the relatively heavier projectile fragments are passed on to output 8 and the relatively lighter granulate particles are passed on to return line 9. For example, separating means 7 may comprise a known-per-se centrifugal separator or a vacuum separator in which the particles and fragments attracted by a created vacuum are separated in such a manner that the heavier particles are passed on to output 8 and the vacuum causes the lighter particles to be drawn back to container 1 through line 9. The necessary vacuum pump may be located inside separating means 7 itself, at opening 10 in return line 9 inside the container 1 or within return line 9 itself. It is contemplated also to return the granulate particles separating means 7 has separated from the projectile fragments to container 1 via return line 9 by positive pressure.

Separation inside separating means may also be effected by the jet from a blower which carries light particles towards return line 9 and allows heavy particles to move to output 8. It is contemplated in this context to use sensors which control the jet in dependence on the nature of the particles they sense (granulate or projectiles or projectile fragments).

Figure 5:
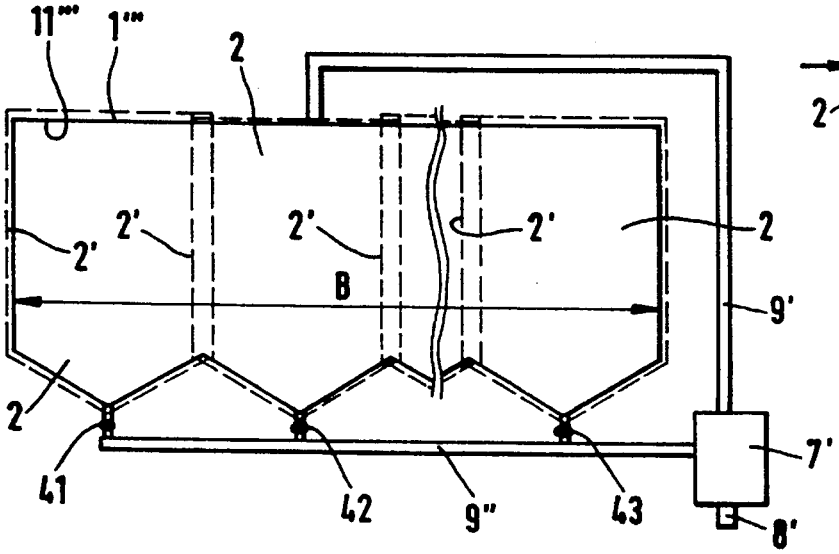
FIG. 5 shows a backstop assembly with a large backstop surface.

FIG. 5 shows a further development of the invention in which a large projectile backstop area, which may have dimensions of 4 m by 8 m, for example, is formed by a container 1''' of which the projectile entry opening 11''' corresponds to the size of the projectile backstop area. Along width B of container 1''', several spaced granulate discharge sites are provided, which may be formed by a plurality of hopper-like sections arranged and interconnected side by side. Each discharge site is connected through a valve 41, 42, 43 with a collecting line 9'' for the discharged granulate containing projectiles and projectile fragments. Collecting line 9' is connected with separating means 7' having an output 8' for projectiles and projectile fragments and an additional output connected with a return line 9' run into the interior of container 1'''. Since a rubber sheet covering all of the large-size opening 11''' is relatively expensive, opening 11''' is preferably sealed by a plurality of rubber sheets 2' placed side by side to abut at their edges or overlap in the manner shown.

The disposal scheme used for this kind of backstop assembly may advantageously be designed to take into account the extent to which the sections thereof are used for target practice within a given operating period since valves 41, 42, 43 may be opened separately in dependence on the projectile (fragment) load the associated sections of granulate 3 experience.

It is pointed out that the walls of container 1, 1', 1'', 1''' preferably consist of steel It is contemplated that at least portions thereof may be concrete walls, as may exist where the assembly is to be installed.

Figure 7:
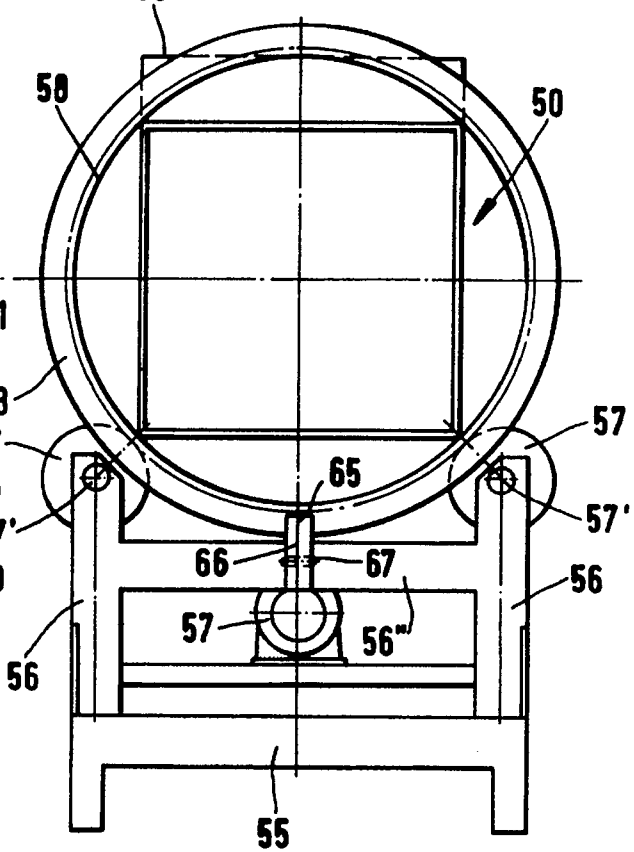
FIG. 7 shows a front view of the backstop assembly of FIG. 6.
Figure 6:
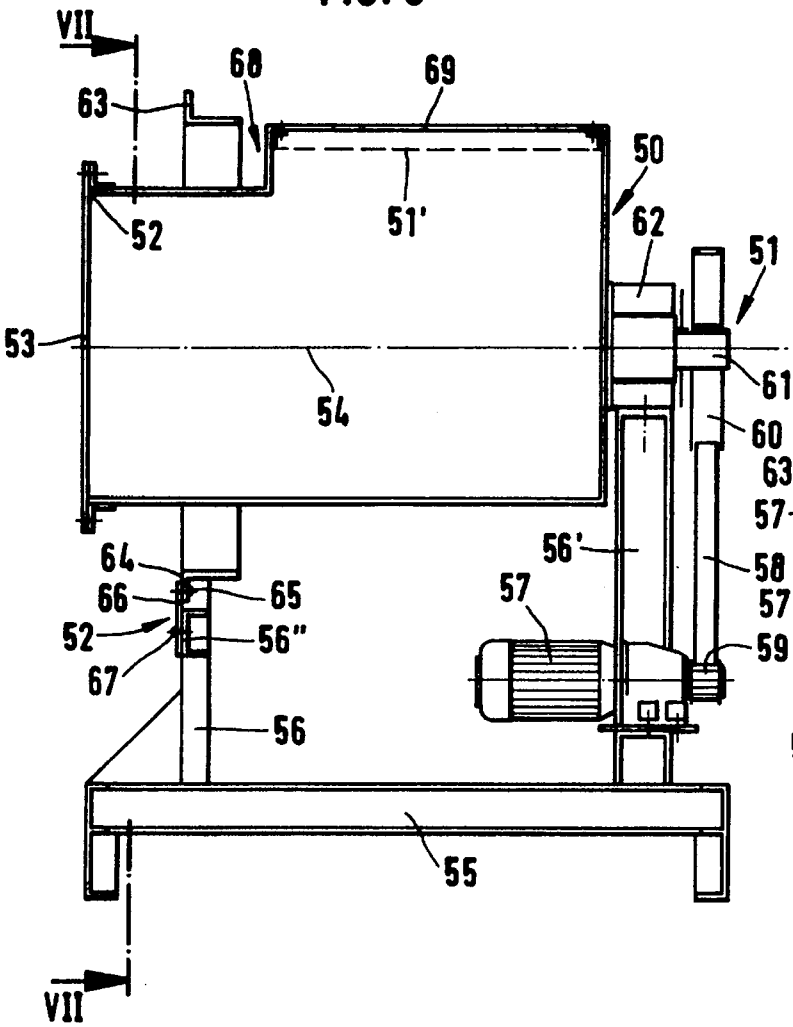
FIG. 6 shows a side view of a backstop assembly with a rotatable container.

FIGS. 6 and 7 show a further development of the invention in which container 50 of the backstop assembly is adapted to have motion imparted thereto by means 51 in such a manner that motion is imparted also to contents of container 50, i.e. to the fired-upon granulate, so as to prevent it from lumping and to ensure that the projectiles fired into the granulate are moved from the main impact area so that newly entering projectiles cannot strike projectiles previously brought to rest by the granulate.

In the embodiment shown in FIGS. 6 and 7, means 51 is constructed to rotate container 50 about its longitudinal axis 54. These rotations keep granulate 51' from lumping; also, projectiles and projectile fragments in granulate 51' are transported away from the impact area behind entry opening 52. Entry opening 52 is sealed by a medium 53 projectiles are capable of penetrating, such as rubber sheeting.

Preferably, container 50 is rotated about its longitudinal axis 54 by being rotatably mounted in a frame preferably formed of a base plate 55 and a plurality of uprights 56', 56'' extending vertically upwards from the base. In particular, two spaced uprights 56'' are provided on one side of base plate 55 and each have at their free end a roll 57 mounted for rotation about an axis 57'. Rolls 57 roll on a race 58 within which container 50 is mounted preferably by race 58 being firmly connected to container 50, which is square in shape, at the four outer edges thereof (see FIG. 7). Container 50 is rotated by a drive motor 57 mounted on base plate 55 or on an upright 56 mounted along the opposite side of base plate 55, the driving power being transmitted by a toothed belt 58 trained around a pinion 59 of drive motor 57 and a driven gear 60 of container 50 to rotate the latter. Driven gear 60 is secured on a drive shaft 61 coaxial with longitudinal axis 54 of container 50 for joint rotation therewith. Drive shaft 51 is journalled in a bearing assembly 62 mounted on upright 56'.

To lock container 50 in a given position, race 58 preferably has at one end an outwardly directed annular flange 63 having an opening 64 therein to lockingly receive a bolt 65 which may be provided on a hinged plate 66 of which the end opposite bolt 65 is rotatable about an axis 67 transverse of the longitudinal extent of bolt 65. What this means is that the plate having locking bolt 65 thereon may be rotated between positions in which bolt 65 lockingly engages or does not engage opening 64, respectively.

In the manner described and shown, container 50 may be formed on one side with an outwardly directed bulge 68 which enables the interior of container 50 to be filled with granulate to a level higher than the container wall 69 from which it extends. This way, the entire area behind projectile entry opening 52 may effectively be filled with granulate. Container 50 may have in a wall thereof—e.g. in the area of the aforesaid bulged portion 68—a cover wall 69 to be attached to the container body by means of threaded fasteners; this cover enables container 50 to be opened for removing spent granulate therefrom and for filling fresh granulate into it. For example, container 50 may be emptied by rotating it into a position in which said cover wall 69 is in its lowermost position.

It is contemplated also to use instead of the container 50 shown, which is rectangular in shape, containers which have a circular cross section in at least portions of the periphery thereof so that the circular portion may be seated directly on rolls 57, obviating race 58.

For example, container 50 may be rotated with a speed of approximately 2 r.p.m., causing any lumps in the granulate to dissolve and projectiles or projectile particles in the granulate to be moved towards the inner container walls, thus keeping the projectile entry area clear of projectiles or projectile particles.

Plate 66, which preferably is part of a hinge assembly, is preferably mounted for rotation about axis 67 on a transverse member 56'' extending between uprights 56. It is contemplated also to provide spaced rolls similar to rolls 57, 57 on each side of container 50 and mounted on the frame, with at least one of such rolls being adapted to be driven for rotating container 50. In a design of this kind, the container may have two races (similar to race 58); alternatively, the container may have a circular cross section in the area of each pair of rolls.

Another embodiment of the invention will now be explained under reference to FIGS. 8 to 10. In this embodiment, a container 70 is similar in construction to the container explained above in connection with FIG. 4.

Provided inside this container in front of rear wall 65 is an agitating mechanism 72 comprising a screw 75. Screw 75 is located in a housing 77 having an opening 78 in its bottom portion. Granulate may be fed through this opening 78 to the area in which screw 75 operates in the bottom region of housing 70. Suitably rotated, screw 75 moves the granulate previously introduced through opening 78 into housing 77 upwardly in the direction of arrow 75' and is discharged at the top end of housing 77 of agitating mechanism 72 in the direction of arrows 79 through openings 80 so as to create a steady flow of granulate.

The rubber sheet overlying the projectile entry opening is shown at 70'''.

In the manner shown in FIG. 8, a drive motor 73 rotates screw 75 through a gear box 74. Drive motor is preferably mounted on top wall 70' of container 70.

Extension tubes 80' may be attached at openings 80, as shown schematically in phantom in FIG. 8 so that the granulate is discharged at locations radially spaced from the axis of screw 75.

In order to get the projectiles or projectile fragments in the granulate to move towards bottom wall 70", vibrating means 81 may be provided as shown in FIG. 9. Vibrating means 81 imparts vibrations to bottom wall 70" which are transmitted to the granulate in container 70 and the projectile particles therein. Since the projectiles and projectile particles are heavier than the granulate particles, the former are moved downwards at a greater rate than the granulate so that they will, accumulate in the region of bottom wall 70". Bottom wall 70" is sloped so that the projectiles and projectile fragments will accumulate at the lowermost point of bottom plate 70".

Vibrating means 81 is shown schematically in FIG. 9. Exemplary components thereof are a drive assembly 82 which imparts vibrations to a vibrator panel 83 preferably through eccentric means (not shown) included in drive assembly 82. Flexible edge bars 84 are used preferably to mount vibrator plate 83 on bottom panel 70" in such a manner that the former can vibrate relative to the latter, such vibrations being received by the flexible edge bars 84 which consist of rubber enclose the marginal area of vibration panel 83 in a C-shaped configuration, for example. One side of the C-shaped edge bars is attached to bottom plate 70".

Another embodiment of the invention will now be explained under reference to FIGS. 11 to 13. In this embodiment, a container 90 preferably in the form explained above under reference to FIG. 4 and having a projectile entry opening 91 covered up e.g. by a rubber sheet 92, an endless chain assembly 93 is provided to impart motion to the granulate. Said endless chain assembly 93 essentially comprises four rolls 94, 95, 96 and 97 spaced in front of rear wall 93" of container 93 in such a way as to lie approximately behind corners of projectile entry opening 91. The roll assemblies are conveniently mounted on rear wall 93".

Figures 11, 12, 13:
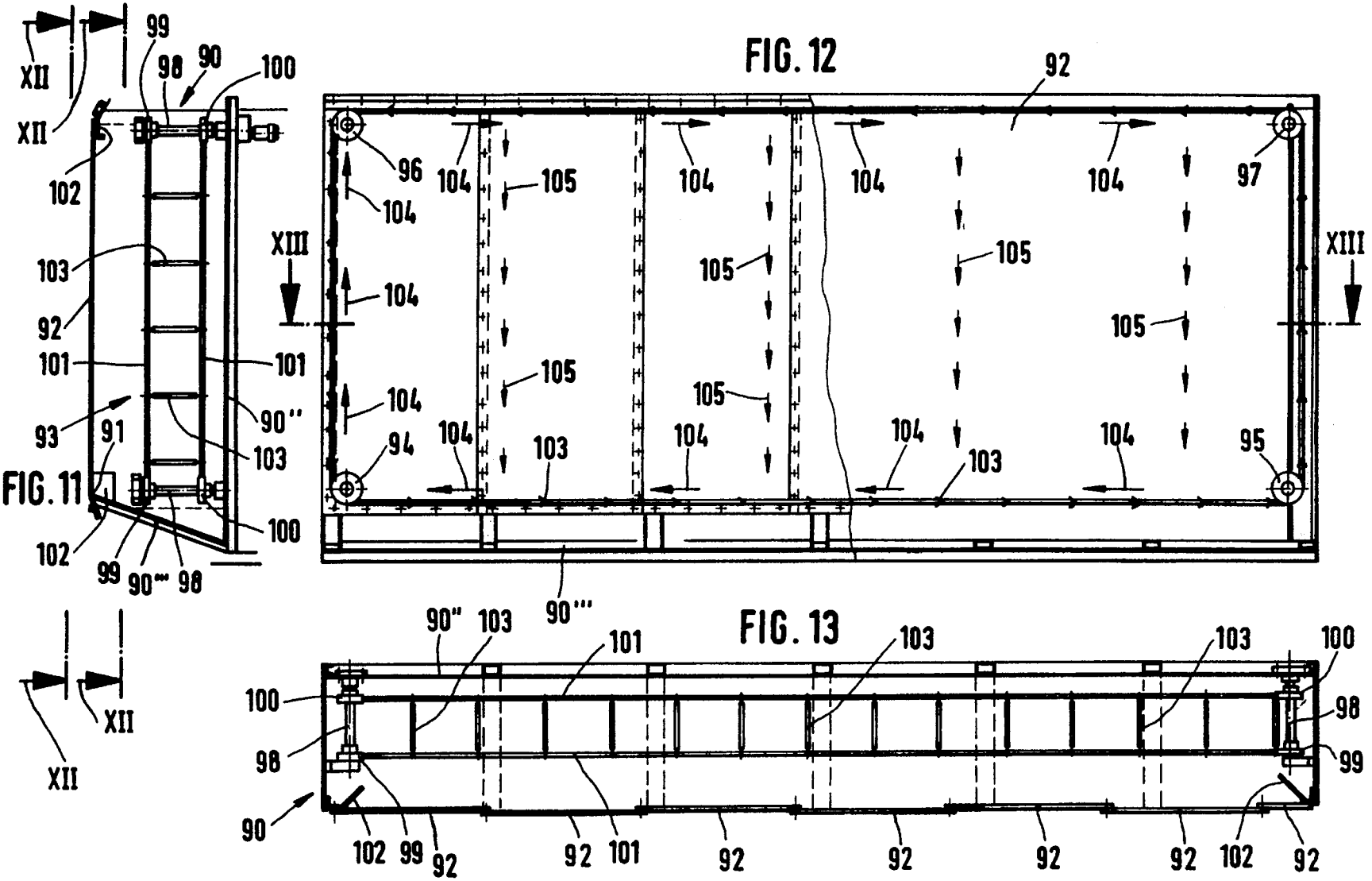
FIG. 11 shows another embodiment of the container for the inventive backstop assembly related in form to that shown in FIG. 4 and using a chain assembly to agitate the granulate.
FIG. 12 shows a cross-sectional view of the embodiment of FIG. 11.
FIG. 13 shows another cross-sectional view of the embodiment of FIG. 11.

In the example shown, each roll assembly 94 to 97 has in the manner specifically shown in FIG. 11 two spaced rolls 99, 100 mounted on one shaft 98. Rolls 99, 100 comprise sprockets around which chains 101 are trained. Since roll assemblies 94 to 95 are located approximately in the corners of projectile entry opening 91, the chains do not run through the main projectile entry region and cannot be damaged during operation of the inventive projectile backstop assembly. Roll assemblies 94 are preferably protected by steel sheet guard members 102 provided in front of them, seen in the shooting direction (see FIG. 1 specifically).

One of shafts 98 is selectively rotated by drive means; sprockets 99, 100 on that shaft (FIG. 11, top righthand corner) are firmly attached thereto for joint rotation.

Spaced endless chains 101, 101 are interconnected preferably in regular intervals by transverse members 103, which in the manner shown in FIG. 12 may have the shape of angled entrainment members. As the chains are circulated in a clockwise direction, the movement of chains 101, 101 and of transverse members 103 along the inner surfaces of the sidewalls, the bottom wall and the top wall of container 90 causes the granulate in the regions of the aforesaid walls of container 90 to be moved (arrows 104). In addition to this peripheral movement, the granulate particles move under gravity from the top to the bottom approximately in the direction of arrows 105 so that the projectiles and/or projectile particles contained in the granulate are moved from the top to the bottom towards bottom wall 93''' to accumulate thereat.

In the manner shown in FIG. 13, guard plates 102 may be angled to form ramps along which impinging projectiles may slide away from roll assemblies 94 to 97 into the interior regions of container 90, thus affording protection of the aforesaid roll assemblies.

It is to be noted that—instead of dual-chain assembly 93—a corresponding single-chain assembly may be used which has projecting transverse entrainment members or the like.

Figure 15:
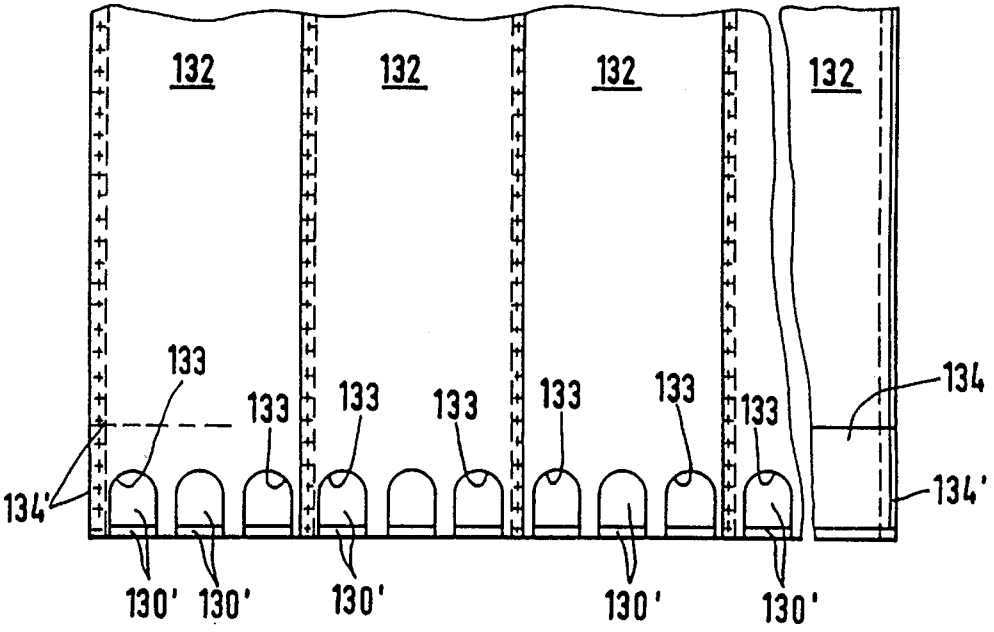
FIG. 15 shows details of the projectile entry openings for the embodiment of FIG. 14.
Figure 14:
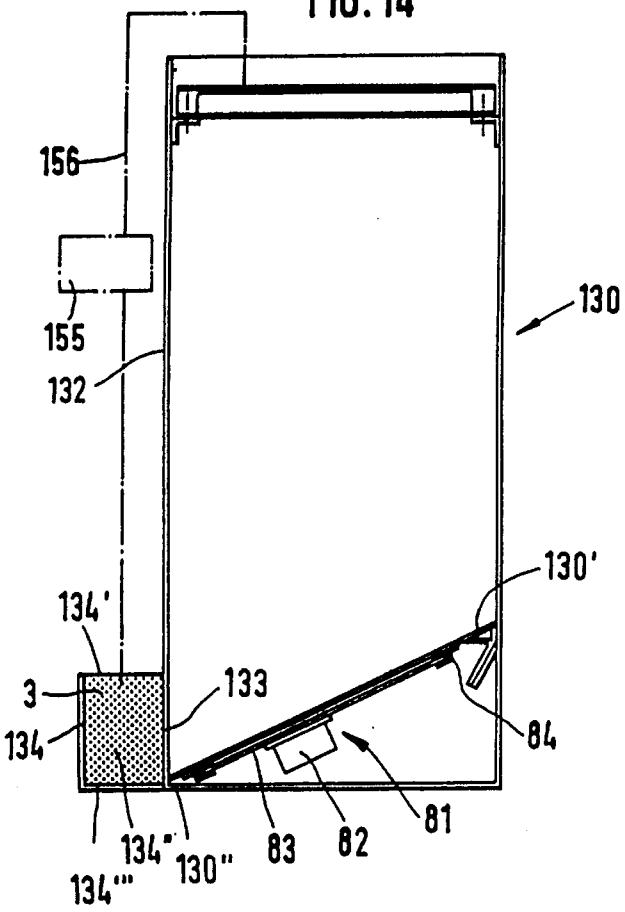
FIG. 14 shows a further embodiment of the container for the inventive backstop assembly, related to that shown in FIG. 9A.

In the following, another further development will be explained under reference to FIGS. 14 and 15 in which container 130 has at its bottom wall 130' the vibrating means previously discussed under reference to FIG. 9. Details of this vibrating means previously explained under reference to FIG. 9 will therefore be identified by like numerals. Lower wall 130' of container 130 is sloped—preferably in a manner that lowermost point 130" of container 130 lies at the front thereof, i.e. on its projectile entry side. As previously explained, the projectile entry opening of container 130 is sealed by a medium 132 preferably in the form of at least one rubber panel through which projectiles can travel and enter container 130. In the manner shown in FIG. 15, and as previously explained under reference to FIG. 12, the projectile entry opening can be formed by a plurality of laterally overlapping media or rubber sheets 132. In the lower marginal region, the at least one rubber sheet 132 of the overlapping multiple rubber sheets 132 have spaced openings 133 through which granulate 3 can enter from container 130 into region 134" in front of openings 133 when vibrating means 81 is operated. Openings 133 have in front of them wall 134 (FIG. 14) spaced from and preferably extending parallel to rubber sheet(s) 132 on the side opposite container 130. The height of wall 134 is selected so as to at least cover up openings 133. Between the sidewalls of container 130 and wall 134 extend sidewall portions 134' (FIG. 14) which together with wall 134 and the lower portions of rubber sheets 132 and a bottom wall portion 134''' form a box-shaped cavity 134" where granulate 3 will accumulate to a predetermined level when vibrating means 81 operates. Once the backstop assembly has been fired at, granulate 3 in cavity 134" has projectiles and/or projectile particles dispersed therethrough.

Wall 134 is preferably made of a material which can be penetrated by the projectiles fired at the backstop assembly. One advantage of that wall is that it forms together with granulate 3 in cavity 134" therebehind a protection for the lower steel structure (lower wall 130', frame members, etc.) since projectiles penetrating wall 134 will be slowed down in cavity 134" before they reach any steel structural element, and this to the point that they cannot exit from cavity 134" any longer after they have struck a said steel structural element.

The granulate 3 in cavity 134", which has projectile fragments and/or projectiles therein, may be cleaned by the vacuum discharge and separating means previously discussed under reference to FIGS. 1 and 5. More specifically, granulate 3 and the projectile fragments therein may be sucked from cavity 134" and passed on to separating means 155 where the projectile fragments are separated from granulate 3. Following the separating means, the cleaned granulate may be recycled to container 130 through line 156 and preferably through the top wall thereof. It is sufficient to operate vibrating means 81 and to discharge granulate 3 from cavity 134" for the removal of projectile fragments after a predetermined operating period such as several times a day if the backstop assembly is intensively used. In the manner described above, the projectile-loaded granulate may be removed from cavity 134" after predetermined operating periods and suitably disposed at a site remote from container 130.

Figure 17:
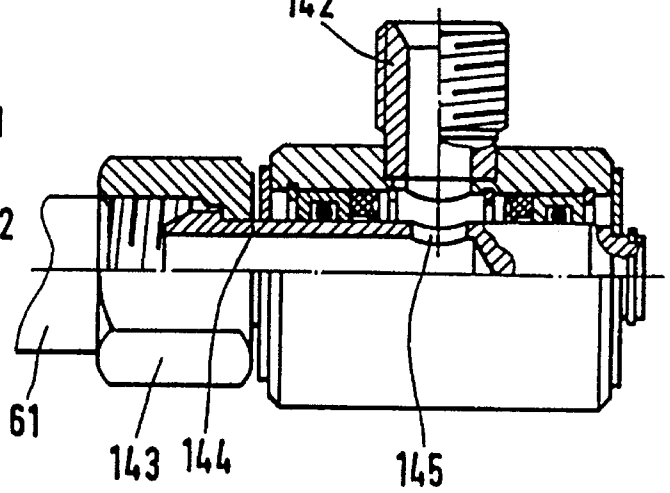
FIG. 17 shows details of an angled rotary union used in the container of FIG. 16.

There will now be explained under reference to FIG. 16 another further development of the embodiment shown in FIGS. 6 and 7, which development is suited specifically for backstopping tracer ammunition projectiles. Details of FIG. 16 previously explained under reference to FIGS. 6 and 7 are identified by like reference numerals. As tracer projectiles penetrate medium 53 and enter container 50, they may cause the particles of granulate 3 to lump or fuse. To counteract this tendency, container 50 has supplied thereto—preferably through an angled rotary union—a quenching fluid such as water. More specifically, drive shaft 61 has an inner bore 61' through which the fluid is introduced in the direction of arrow 140. On its free end, shaft 61 has an angled rotary union 141 attached thereto which communicates rotating drive shaft 61 with a supply line 142 to pipe the liquid to the point of use. Angled rotary unions of this kind are known; for example, they may be attached to rotating drive shaft 61 by means of a coupling or union nut 143 in the manner shown in FIG. 17. Union nut 143 is held on a tube 144 for rotation in a fluid-tight seal. Tube 144 communicates with supply line 142 through an opening 145.

Figure 16:
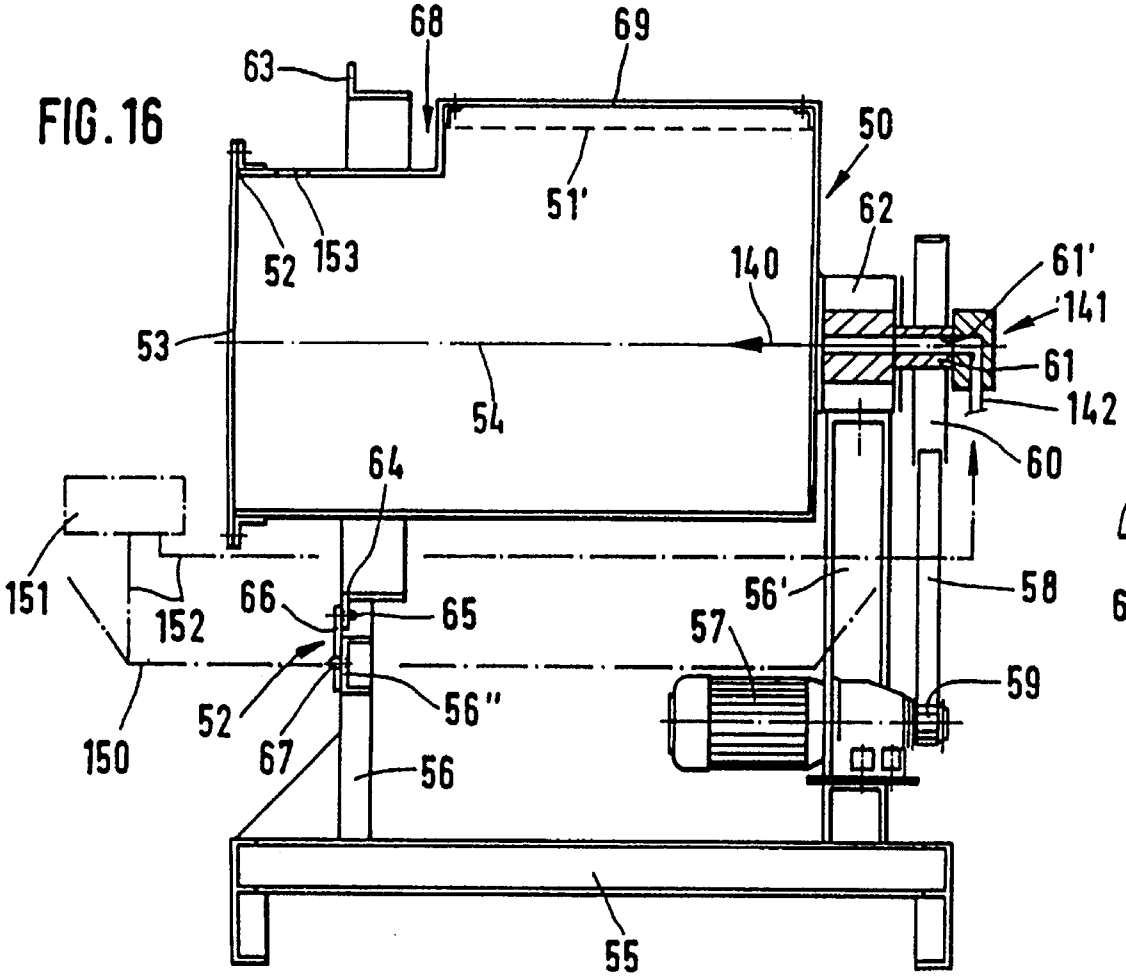
FIG. 16 shows yet another embodiment of the container for the inventive backstop assembly, related to that shown in FIGS. 6 and 7.

For collecting quenching fluid escaping from container 50, a collecting vessel 150 may be provided where shown in phantom in FIG. 16; conveniently, this vessel has the form of a pan or trough 150 placed underneath container 50 particularly to catch the liquid dripping from leaks caused in medium 53 by the projectiles passing therethrough. A pump 151 and a return line 152 may be used to remove that fluid from pan 150 for return to container 50 through supply line 142. Pump 151 preferably has a reservoir so that, when the latter is full, the fluid may be discharged into container 50 through supply line 142 and bore 61'.

High velocity projectiles or tracer projectiles may produce a large amount of heat within the granulate material, causing the individual granulate particles to adhere to each other. The adhesion of these particles reduces the effectiveness of the granulate as a backstop medium.

Adhesion of the granulate particles is overcome by interspersing a particulate matter such as talc between the granulate particles. The talc adheres to the outside surface of the particles and prevents adhesion, especially in the presence of heat generated by entering projectiles. Talc is a preferred particulate matter because it is cheap, readily available, and is non-volatile in the presence of heat. However, it will be recognized that other particulate matter with similar lubrication characteristics as talc may be substituted without loss of generality.

Figure 18:
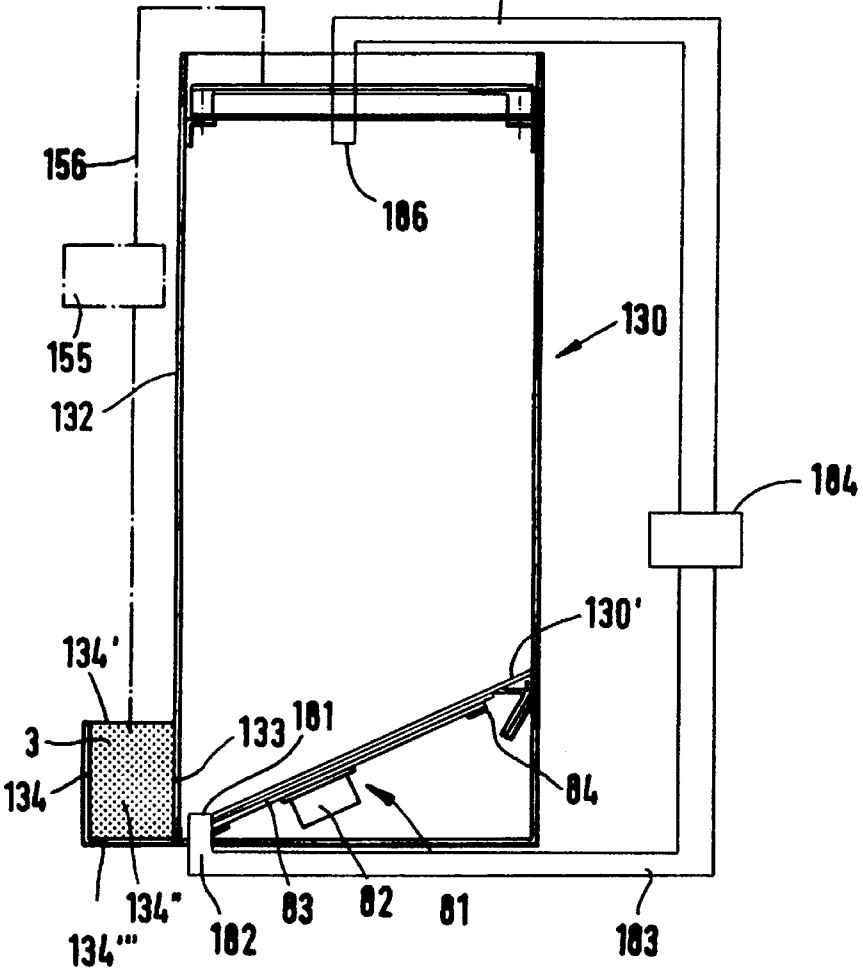
FIG. 18 shows an embodiment of the container for the inventive backstop assembly having a liquid cooling system.
Figure 22:
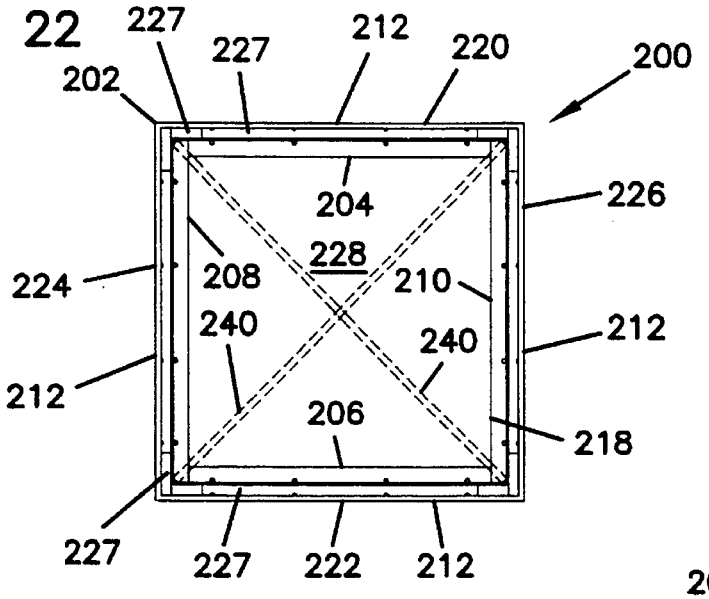
FIG. 22 shows a bottom view of the backstop assembly of FIG. 20.
Figure 20:
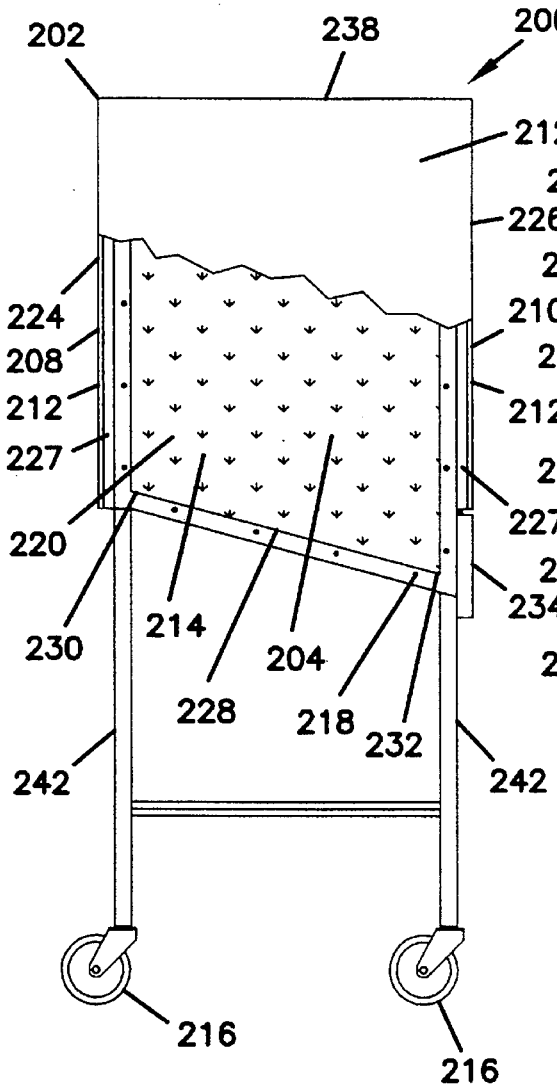
FIG. 20 shows a side view of a moveable backstop assembly constructed in accordance with the principles of the present invention.
Figure 21:
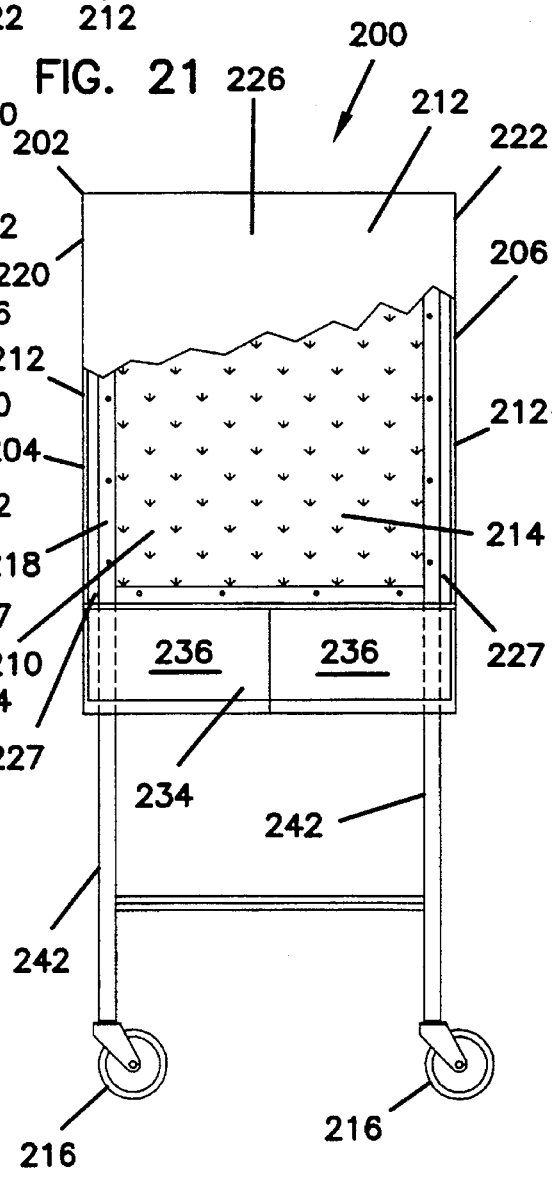
FIG. 21 shows another side view of the backstop assembly of FIG. 20.

Heat generated within the granulate material by entering projectiles or tracer rounds is reduced by the preferred backstop apparatus of FIG. 18. A pump 184 is used to pump a liquid coolant such as water from reservoir 183 up through pipe 185 where the liquid coolant is dispersed at 186 above the granulate material. The liquid coolant flows downward through the granulate by gravitational action, contacting the bottom wall 130 and collecting at opening 181. The liquid coolant returns to reservoir 183 via return channel 182. It will be recognized that non-volatile liquid coolants other than water may be substituted without loss of generality. It will also be recognized that it is possible to combine the use of a particulate matter such as talc with the liquid coolant such as water in order to have the combined effect of preventing adhesion of the granulate particles and reducing heat within the backstop assembly.

A particulate matter may also be interspersed between the granulate particles to cause the granulate to be self-extinguishing or fire-retardant in the presence of heat generated by entering high-velocity projectiles or incendiary projectiles. A preferred self-extinguishing particulate matter is a noncorrosive sodium bicarbonate based chemical as commonly found in fire extinguishers. However, it will be recognized that other particulate matter with similar self-extinguishing characteristics as noncorrosive sodium bicarbonate may be substituted without loss of generality. The self-extinguishing particulate matter be may used either with or without the lubricating particulate matter or liquid. It will be recognized that a lubrication property and a self-extinguishing property may be contained together in the same particulate matter or liquid. It will be further recognized that a self-extinguishing material, not necessarily based on a noncorrosive sodium bicarbonate chemical, may also be annealed to, coated, permeated within, or otherwise provided as the outside surface of the granulate particles according to well-known manufacturing techniques to achieve the same self-extinguishing or fire retardant characteristics as a particulate matter interspersed between the granulate particles.

Once the granulate has been lubricated to reduce adhesion of the particles, entering projectiles cause previously trapped projectiles to move further downward through the lubricated granulate. Entering projectiles cause cavitation within the granulate, thereby creating voids which cause the previously entrapped projectiles to move downward from the place at which they were originally resting prior to the entrance of other projectiles.

Figure 19:
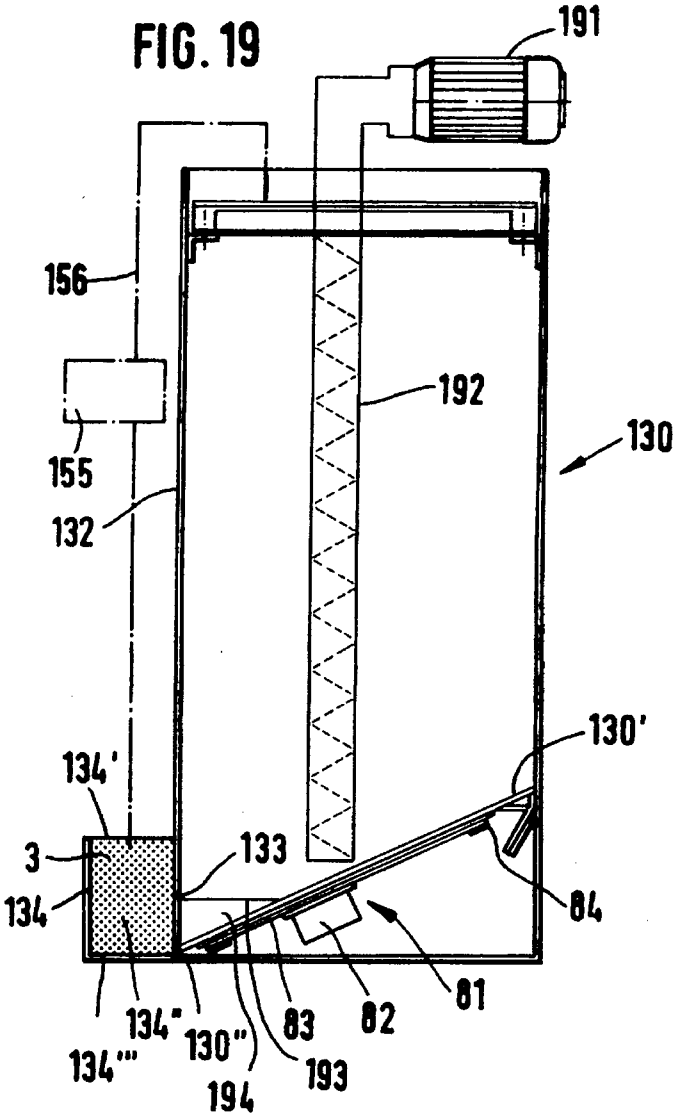
FIG. 19 shows an embodiment of the container for the inventive backstop assembly having a granulate circulation screw.

The preferred system for keeping the granulate behind the bullseye free of projectiles, recycling the granulate, and removing the projectiles is shown in FIG. 19. A motor 191 drives a granulate circulation screw 192 to move the entire mass of granulate downward in the main chamber towards the discharge opening 133. Periodically, the system is activated to agitate the granulate in the main chamber to cause it to flow toward the discharge opening 133 while the granulate is removed from the base holding area 134 by conveyor, vacuum device, or other means 155 which lifts and deposits only the granulate back into the top of the main chamber. The projectiles are screened from the granulate by screen 193 and remain in the projectile holding area 194. The entire mass of granulate and projectiles moves toward the main chamber discharge opening 133, and the cleaned granulate is deposited at the main chamber top opening to replenish the granulate level. Projectiles may be separated and captured during this process through screening, centrifuge, or by other separation means. Preferably, cleansing and recycling of the granulate is done more often than the removal of the projectiles. Projectile separation from the granulate and removal from the trap is accomplished by blocking the flow of material from the main chamber discharge opening 133. The granulate in the projectile holding area 134 is then vacuumed or otherwise removed and deposited back into the main chamber top opening or into the base holding area or into both areas. The vacuum device is incapable of lifting the heavier projectiles and they remain in the hold area for removal with a scoop or shovel. It will be recognized that the same separation principle also applies to conveyors or other deliverance means other than vacuum means or circulation screw, and that the projectiles may be screened by screen 193 and collected in the projectile holding area 194. The circulation system may preferably be turned on again to allow the main chamber granulate material to flow into and fill the base holding area. Again the main chamber discharge opening 133 is preferably blocked and the process repeated. If necessary, clean granulate is preferably added to the main chamber to maintain the correct level.

Entrapped projectiles may be further encouraged to move downward through the granulate by means of agitation induced by either fixed or portable vibrating means applied to the front, back, bottom, or sides of the enclosure. The portable vibrating means allows an operator to selectively agitate a portion of the enclosure, typically where the concentration of entrapped projectiles is expected to be the highest. The portable vibrating means may further comprise an extension which may be lowered at any level into the enclosure from above to directly agitate selected areas of the granulate within the enclosure.

FIGS. 20–23 illustrate another backstop assembly 200 which is an embodiment of the present invention. The backstop assembly 200 includes a box-like container 202 having first, second, third and fourth target openings 204, 206, 208, 210 defined by the sides of the container for allowing projectiles to enter the container 202. The target openings 204, 206, 208, 210 are covered by self-healing sheets 212 which enclose the sides of the container 202. The self-healing sheets 212 are penetrated by the projectiles when the projectiles enter the container 202. Held within the container 202 is soft particulate material 214 for slowing down and capturing the projectiles within the container 202. The backstop assembly 200 also includes a structure for facilitating movement of the backstop assembly 200 such as wheels 216 which are connected to the container 202.

Structural support for the box-like container 202 is preferably provided by a welded steel framework 218 which defines the outer edges of the container 202. The framework of the container 202 defines opposing first and second trapezoid shaped sides 220, 222 which respectively define the first and second target openings 204, 206. The framework 218 of the container 202 also defines opposing first and second rectangle shaped sides 224, 226 which respectively define the third and fourth target openings 208, 210.

As described above, the sides of the container 220, 222, 224, 226 are enclosed by the self-healing sheets 212. The self-healing sheets 212, 222, 224, 226 are connected to the framework 218 by conventional fastening methods such as screws or bolts which are arranged about the perimeters of the sheets 212, 222, 224, 226 and engage the framework 218. The sheets 212, 222, 224, 226 effectively cover the target openings 204, 206, 208, 210 such that the particulate material 214 is held within the container 202. Additionally, the framework 218 of the container is preferably covered with an extra layer 227 of rubber sheet, located between the framework 218 and the self-healing sheets 212, for preventing projectiles from ricocheting off the framework 218.

The container 202 preferably includes a base plate 228 which is welded to the framework 218 at the bottom of the container 202 and supports the particulate material 214 within the container 202. The base plate 228 is inclined and has an upper edge 230 and a lower edge 232. The lower edge 232 is positioned adjacent to a rectangular discharge opening 234 defined by the second rectangular side 226 and located below the fourth target opening 210. Because the discharge opening 234 is located adjacent to the lower edge 232 of the base plate 228, the discharge opening 234 facilitates removal of the particulate material 214 and captured projectiles from the container 202. It will be appreciated that when the backstop assembly 200 is in use, the discharge opening 234 is preferably covered by steel shutters 236 which prevents the particulate material 214 from escaping from the container 202.

The backstop assembly 200 further includes a removable top panel 238 which encloses the top of the container 202 to prevent the particulate material 214 from escaping while the backstop assembly 200 is in use. The top panel 238 is supported on angular frame members 243 which are connected to the framework 242 adjacent the top of the container 202.

The backstop assembly 200 also preferably includes four legs 242 which are preferably connected to the framework 218 adjacent the bottom of the container 202. The legs 242 extend vertically downward from the container 202 and serve the purpose of elevating the container 202. The members 240 are arranged generally in the shape of a cross and provide rigidity for the leg 242.

The wheels 216 of the backstop assembly 200 are preferably connected to the bottoms of the legs 242 such that the backstop assembly 200 can be easily reoriented in order to expose the different sides 220, 222, 224, 226 of the container 202 to projectile fire. The wheels 216 of the backstop assembly 200 are preferably casters so that the backstop assembly 200 can be easily rotated. Additionally, it will be appreciated that the wheels 216 are preferably equipped with conventional locking mechanisms such that the backstop assembly 200 will not move upon impact by a projectile.

It will be appreciated that the particulate material 214 and self-healing sheets 212 have the same composition as the particulate material and self-healing sheets described with respect to the backstop assembly of FIG. 1. Additionally, it will be appreciated that the size and number of sides of the container 202 may be varied without departing from the scope of the present invention.

Figure 23:
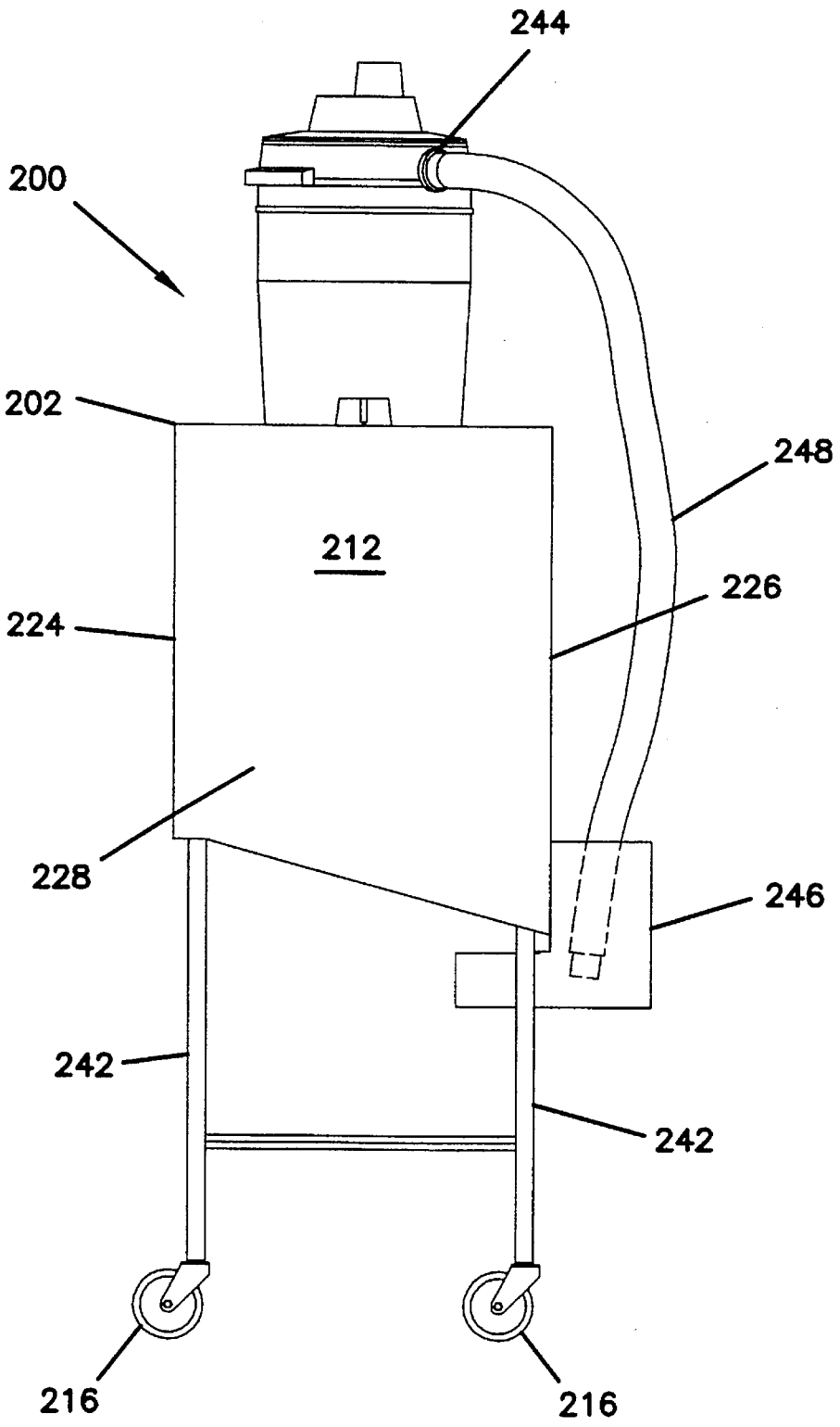
FIG. 23 shows a side view of the backstop assembly of FIG. 20 including a vacuum assembly.

FIG. 23 shows the backstop assembly 200 including a conventional vacuum assembly 244 mounted to the top panel 238 of the container 202 by conventional fastening methods such as screws. In place of the shutters 236, a rectangular trough 246 is connected to the container 202 adjacent to the container discharge opening 234 for containing the particulate material 214 which exits via gravity from the discharge opening 234. The vacuum assembly 244 includes a hose 248 having a distal end within the rectangular trough 246. By activating the vacuum assembly 244, particulate material 214 and projectiles contained in the trough 246 are evacuated from the trough 246 thereby enabling the container 202 to be emptied for the purpose separating out the captured projectiles and recycling the particulate material 214.

It will be appreciated that when the backstop assembly 200 is in use, the trough 246 is removed from the container 202 and replaced with the shutters 236.

Figure 24:
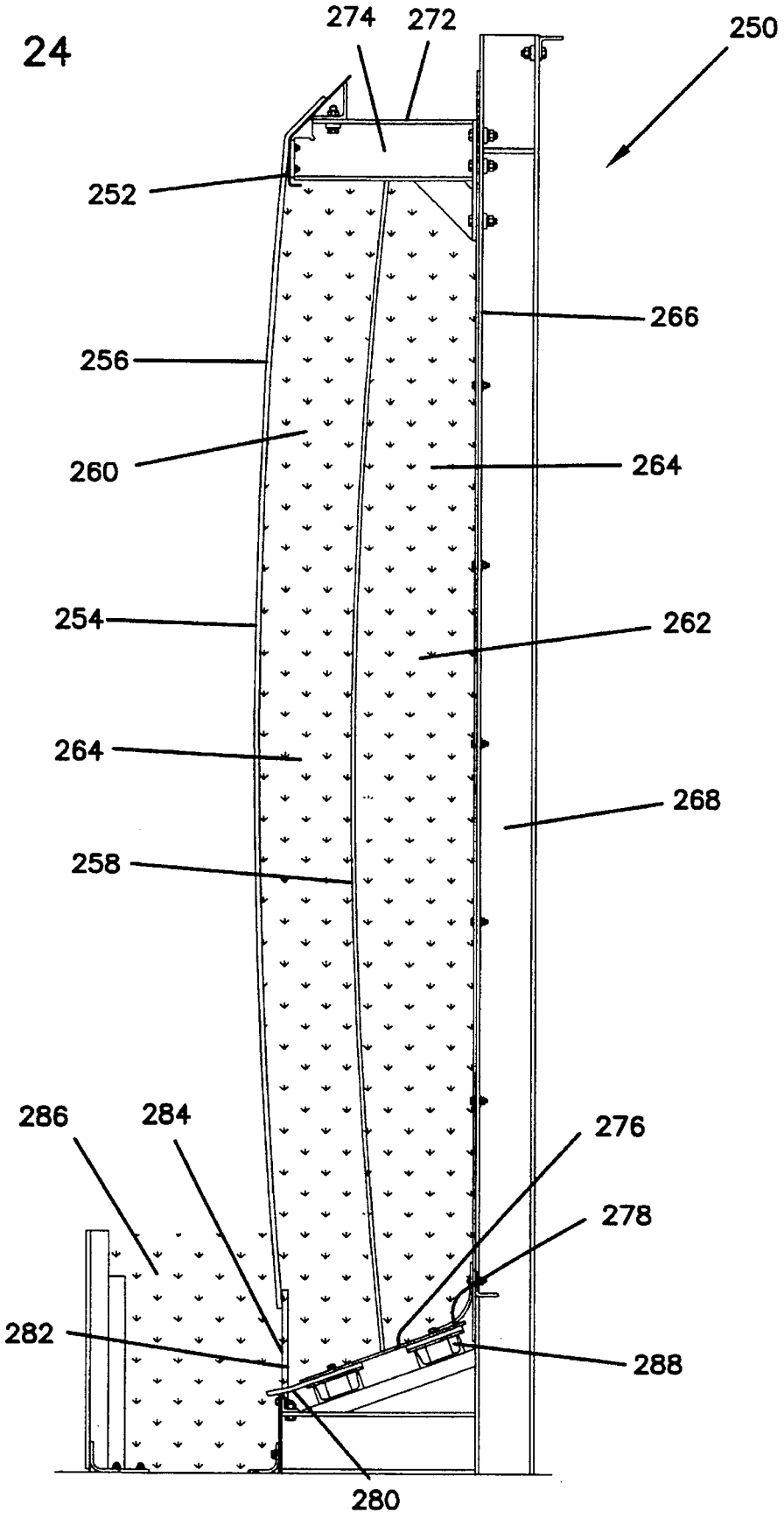
FIG. 24 shows a side view of another backstop assembly constructed in accordance with the principles of the present invention.

FIG. 24 illustrates another backstop assembly 250 which is an embodiment of the present invention. The backstop assembly 250 includes a generally rectangular box-shaped container 252 having an opening 254 for allowing projectiles to enter the container 252. The opening 254 of the container 250 is covered by a first self-healing medium 256 such that the projectiles penetrate the first self-healing medium 256 upon entering the container 252. The backstop assembly 250 further includes a second self-healing medium 258 which divides the container 252 into first and second chambers 260 and 262. The first and second chambers 260 and 262 of the container 252 are filled with soft particulate material 264 for slowing down and capturing the projectiles within the container 252.

As described above, the container 252 is generally box-shaped and defines the opening 254 at the front of the container 252 for allowing entrance of projectiles into the container 252. The back of the container is preferably enclosed by a steel back plate 266 positioned opposite from the opening 254. The back plate 266 is preferably bolted to a frame system 268 which provides structural support to the container 252.

The sides of the container 252 are preferably enclosed by a pair of opposing steel, side plates (not shown) which extend between the front and back of the container 252 and are connected to the frame system 268 adjacent the back plate 266. It will be appreciated that the side plates have been omitted from FIG. 24 for the purpose of better illustrating the backstop assembly 250.

The top of the container 252 is enclosed by a top panel 272 which is supported by a generally horizontal portion 274 of the frame system 268. The top panel 272 is removable to enable the container 252 to be filled with the particulate material 264 from the top.

The bottom of the container 252 is preferably enclosed by an inclined base plate 276 having upper and lower edges 278 and 280 connected to the frame system 268. A rectangular extension plate 282 aligned generally parallel to the back plate 266 is located adjacent to the lower edge 280 of the base plate 276. The extension plate 282 has a plurality of discharge openings 284 which allow the particulate material 264 and spent projectiles to exit the container 252 via gravity and accumulate in a collection reservoir 286. It will be appreciated that the base plate 276 of the container 252 may be equipped with an agitator 288, as previously described in the specification, for encouraging the particulate material 264 and spent projectiles to migrate through the discharge openings 284 from the container 252 into the collection reservoir 286.

As described above, the first self-healing medium 256 encloses the opening 254 at the front of the container 252. The first self-healing medium 256 is aligned generally parallel to the back plate 266 and is connected by conventional fastening methods to the horizontal portion 274 of the frame system 268 at the top of the container 252 and the extension plate 282 at the bottom of the container 252. Similarly, the second self-healing medium 258 is connected to the horizontal portion 274 of the frame system 268 at the top of the container 252 and the base plate 266 at the bottom of the container 252. The second self-healing medium 258 is aligned generally parallel to the first self-healing medium 256 and is positioned between the first self-healing medium 256 and the back plate 266 such that the first chamber 260 is defined between the first self-healing medium 256 and the second self-healing medium 258 and the second chamber 262 is defined between the second self-healing medium 258 and the back plate 266. Both the first and second chambers 260 and 262 are filled with soft particulate material 264 for slowing down and capturing the projectiles within the container 252.

In use, projectiles are fired at the front of the backstop assembly 250. The projectiles penetrate the first self-healing medium 256 and are slowed down by the particulate material 264 in the first chamber 260. Only a small percentage of the projectiles have enough inertia to pass through both the first self-healing medium 256 and the second self-healing medium 258. Therefore, a majority of the projectiles are captured within the first chamber 260 while only a few projectiles are captured within the second chamber 262. Because the first and second chambers 260 and 262 are separated by the second self-healing medium 258, the first chamber 260 can be emptied of its particulate material 264 and captured projectiles without emptying the second chamber 262.

The division of the container 252 into two separate chambers 260 and 262 is significant because the first chamber 260 captures a majority of the projectiles and therefore needs to have its particulate material 264 replaced more often than the second Chamber 262. By employing two chambers 260, 262, it is not necessary to replace all of the particulate material 264 in the container 252 when the particulate material closest to the source of the projectile fire reaches full capacity. Instead, only the particulate material 264 in the first chamber 260 needs to be regularly replaced. The particulate material 264 in the second chamber 262 is replaced at much less frequent intervals than the particulate material 264 in the first chamber 260 thereby improving the cost effectiveness of the backstop assembly.

It will be appreciated that the details regarding the particulate material 264 and the first and second self-healing mediums 256, 258 have been previously described in the specification.

The present invention is to be limited only in accordance with the scope of the appended claims, since others skilled in the art may devise other embodiments still within the limits of the claims.

What is claimed is:

1. A backstop assembly for capturing projectiles and projectile fragments comprising:

a container having a plurality of sides, wherein at least two of the sides define target openings for allowing the projectiles to enter the container;

a plurality of self-healing sheets covering the target openings, whereby the projectiles penetrate the self-healing sheets in order to enter the container;

a particulate material contained within the container for slowing down and capturing the projectiles within the container; and means for facilitating movement of the container.

2. The backstop assembly of claim 1, wherein the means for facilitating movement of the container comprises a plurality of wheels.

3. The backstop assembly of claim 1, wherein the means for facilitating movement of the container comprises a plurality of casters.

4. The backstop assembly of claim 1, wherein the container includes an inclined base plate having a lower edge, and the container defines a discharge opening located adjacent to the lower edge of the inclined base plate for facilitating removal of the particulate material and projectiles from the container.

5. The backstop assembly of claim 1, further comprising a vacuum source selectively in fluid communication with a discharge opening defined by the container, whereby the vacuum source selectively provides vacuum to the discharge opening of the container for evacuating the particulate material and projectiles from the container.

6. The backstop assembly of claim 1, wherein the self-healing sheets are rubber.

7. The backstop assembly of claim 1, wherein the particulate material comprises granulate rubber.

8. A backstop assembly for capturing projectiles and projectile fragments comprising:

a container having an opening for allowing the projectiles to enter the container, the container including first and second chambers defined by a first self-healing medium positioned within said container;

a self-healing medium covering the opening, whereby the projectiles penetrate the first self-healing medium in order to enter the container; and a particulate material contained within the first and second chambers of the container for slowing down and capturing the projectiles within the container, whereby the particulate material and projectiles contained in the first chamber can be removed without removing the particulate material and projectiles contained in the second chamber.

9. The backstop assembly of claim 8, wherein the self-healing medium comprises rubber.

10. The backstop assembly of claim 8, wherein the particulate material comprises granulate rubber.

11. A backstop assembly for capturing projectiles and projectile fragments comprising:

a container having an opening for allowing the projectiles to enter the container and a back plate positioned opposite from the opening;

a first self-healing medium covering the opening, whereby the projectiles penetrate the first self-healing medium in order to enter the container;

a particulate material contained within the container for slowing down and capturing the projectiles within the container; and a second self-healing medium which divides the container into first and second chambers, the first chamber being defined between the first self-healing medium and the second self-healing medium and the second chamber being defined between the second self-healing medium and the back plate of the container, whereby the first chamber catches a majority of the projectiles, and the particulate material and projectiles contained within the first chamber can be removed without removing the particulate material and projectiles contained within the second chamber.

12. The backstop assembly of claim 11, wherein the first and second self-healing mediums comprises rubber.

13. The backstop assembly of claim 11, wherein the particulate material comprises granulate rubber.

14. The backstop assembly of claim 11, wherein the container includes an inclined base plate having a lower edge, and a plurality of discharge openings defined by the container adjacent to the lower edge of the base plate for facilitating removal of the particulate material and projectiles from the container.

15. The backstop assembly of claim 14, further comprising an agitator for encouraging the particulate material and projectiles to migrate through the discharge openings of the container.

16. The backstop assembly of claim 14, further comprising a reservoir located adjacent to the discharge openings for containing the particulate material and projectiles which migrate through the discharge openings of the container.

* * * * *